US010369613B2

(12) United States Patent
Xu et al.

(10) Patent No.: US 10,369,613 B2
(45) Date of Patent: Aug. 6, 2019

(54) DIE ASSEMBLY FOR A STAMPING PRESS

(71) Applicant: GM GLOBAL TECHNOLOGY OPERATIONS LLC, Detroit, MI (US)

(72) Inventors: Siguang Xu, Rochester Hills, MI (US); Charles Prabhakaran, Bengaluru (IN)

(73) Assignee: GM Global Technology Operations LLC, Detroit, MI (US)

( * ) Notice: Subject to any disclaimer, the term of this patent is extended or adjusted under 35 U.S.C. 154(b) by 268 days.

(21) Appl. No.: 15/425,370

(22) Filed: Feb. 6, 2017

(65) Prior Publication Data

US 2018/0221934 A1 Aug. 9, 2018

(51) Int. Cl.

| | |
|---|---|
| ***B21D 37/10*** | (2006.01) |
| ***B21D 22/02*** | (2006.01) |
| ***B21D 5/02*** | (2006.01) |
| ***B30B 15/00*** | (2006.01) |
| ***B21D 13/02*** | (2006.01) |
| *B21D 37/01* | (2006.01) |

(52) U.S. Cl.

CPC ..... *B21D 37/10* (2013.01); *B21D 5/02* (2013.01); *B21D 13/02* (2013.01); *B21D 22/02* (2013.01); *B30B 15/007* (2013.01); *B21D 5/0272* (2013.01); *B21D 37/01* (2013.01)

(58) Field of Classification Search

CPC ..... B21D 5/0272; B21D 5/02; B21D 37/10; B21D 13/02; B21D 37/01; B30B 15/007

USPC ..... 72/470

See application file for complete search history.

(56) References Cited

U.S. PATENT DOCUMENTS 4,426,873 A * 1/1984 Pearson ..... B30B 15/007 72/389.5
4,580,434 A * 4/1986 Graf ..... B21D 5/0272 100/258 R
4,732,032 A * 3/1988 Kogure ..... B21D 5/0272 100/46
4,930,339 A * 6/1990 Corsini ..... B21D 5/0272 72/389.5

(Continued)

FOREIGN PATENT DOCUMENTS

CN 103178276 A 6/2013
CN 203853439 U 10/2014

(Continued)

OTHER PUBLICATIONS

Jin, Chul Kyu., et al. "Fabrication of Stainless Steel Bipolar Plates for Fuel Cells Using Dynamic Loads for the Stamping Process and Performance Evaluation of a Single Cell". Sciencedirect.com. pp. 21461-21469, May 10, 2014.

(Continued)

*Primary Examiner* — David B Jones
(74) *Attorney, Agent, or Firm* — Quinn IP Law

(57) ABSTRACT

A die assembly for use in a stamping press is provided. The die assembly includes a first die plate, a first curved die stiffener, and a first die shoe. The first die plate may be configured to form at least a portion of material into a desired configuration. The first curved die stiffener may be affixed to the first die plate on a first curved side of the first curved die stiffener. The first die shoe may be affixed to a second side of the first curved die stiffener. The first die shoe may be operatively configured to be mounted on a first press base.

20 Claims, 7 Drawing Sheets

(56) References Cited

U.S. PATENT DOCUMENTS

| | | | | |
|---|---|---|---|---|
| 6,401,512 | B1 * | 6/2002 | Gascoin | B21D 5/02 72/389.4 |
| 6,913,120 | B2 | 7/2005 | Bosco et al. | |
| 7,503,200 | B2 * | 3/2009 | Gerritsen | B21D 5/0272 100/258 A |
| 8,925,365 | B2 | 1/2015 | Schollhammer | |
| 2016/0344040 | A1 | 11/2016 | Jeong | |
| 2016/0361174 | A1 | 12/2016 | McMinn | |
| 2018/0105308 | A1 | 4/2018 | Futase | |

FOREIGN PATENT DOCUMENTS

| | | | |
|---|---|---|---|
| DE | 4415577 | A1 | 11/1995 |
| DE | 102007058634 | A1 | 6/2009 |
| DE | 102011105518 | A1 | 12/2012 |
| DE | 102016115446 | A1 | 2/2018 |
| EP | 1055510 | A2 | 11/2000 |

OTHER PUBLICATIONS

Hu, Qinghui., et al. "Investigation of Stamping Process of Metallic Bipolar Plates in PEM Fuel Cell—Numerical Simulation and Experiments". Sciencedirect.com. pp. 13770-13776, Feb. 24, 2014.

Hedrick, Art. "Die Basics 101 Starts With Eight Basic Components". Thefabricator.com., Aug. 8, 2006.

"Sheet Metal Stamping Dies & Processes", Fundamental Manufacturing Processes Study Guide, DV11PUB9. sme.org.

* cited by examiner

DIE ASSEMBLY FOR A STAMPING PRESS

TECHNICAL FIELD

The present disclosure relates to the manufacture of stamped metal plates, and in particular, dies used in a stamping press to form a stamped bipolar plate.

BACKGROUND

The stamping process is well-known for mass production. However, the traditional stamping process requires massive time to design the mold and optimize the process conditions, and the miniaturization of the flow channels dimensions makes the process more complex. The wrinkle and rupture are the main defects in the metal bipolar plates stamping process. Moreover, undesirable dimensional variability in the channel depth of a metal bipolar plate presents performance issues among other issues.

The dimensions of the flow channel and the conditions of the stamping process play important roles on the formability of stamping process. Research on dimension design has been developed widely. However, attention has mostly focused on the effect of channel dimensions and the efficiency of flow channel while less attention has been focused on the effects when forming a flow channel.

As is generally known, stamped components are made by forming, trimming, blanking or piercing metal—in sheet or coil form between two halves (upper and lower) of a stamping press tool called a die assembly. The upper member or members are attached to slide or slides of the press and the lower member is clamped or bolted to the bed or bolster. The die is designed to create the shape and size of a component. The two halves of the die are brought together in the press. Both force (load) and accuracy are required to achieve the repeatability and tolerance requirements.

The die assembly used in a stamping press is a special, one-of-a-kind precision tool that cuts and forms sheet metal 46 into a desired shape or profile—such as a bipolar plate having flow channels and metal beads. The die's cutting and forming sections typically are made from special types of hardenable steel called tool steel. Dies also can contain cutting and forming sections made from carbide or various other hard, wear-resistant materials.

Most stamping dies are constructed of several basic components which may include die plates, shoes, die sets, guide pins, bushings, heel blocks, heel plates, screws, dowels, and keys. Dies also need stripper, pressure, and drawing pads, as well as the devices used to secure them; spools, shoulder bolts, keepers, and retainers, as well as gas, coil, or urethane springs.

Die plates, shoes, and die sets are steel or aluminum plates that correspond to the size of the die. The die shoes serve as the foundation for mounting the working die components. Most die shoes are made from steel. Aluminum also is a popular die shoe material. Aluminum is one-third the weight of steel, it can be machined very quickly, and special alloys can be added to it to give it greater compressive strength than low-carbon steel. Aluminum also is a great metal for shock adsorption, which makes it a good choice for blanking dies. The upper and lower die shoes are assembled together with guide pins in order to create the die set or die assembly. Guide pins, sometimes referred to as guide posts or pillars, function together with guide bushings to align both the upper and lower die shoes precisely in a stamping press.

Referring again to FIG. 1, the traditional bipolar plate is shown. The bipolar plate divides the unit cells in the fuel cell stack, and at the same time, serves as a current path (a path for transferring generated electricity) between the unit cells. The bipolar plate 110 may generally have a rectangular shape. The bipolar plate 110 has a reaction region 130 which has flow fields 131 for air, hydrogen, and coolant. Opposite end portions of the reaction region 130 have inlet manifold holes 132 and exit manifold holes 134 through which air, hydrogen, and coolant enter and exit, respectively.

The flow fields or flow channels 112 formed in the bipolar plate 110 serve as a path for transferring reactant gases to the GDL, a path for the pass of coolant, and a path for discharging water, which is produced by the electrochemical reaction and is discharged through the GDL, to the outside. However, it is difficult for the metallic bipolar plate 110 manufactured by a stamping press to achieve the optimum complex shape with very tight tolerances.

As indicated, bipolar plates are manufactured by forming relief/patterns (flow channels and beads) in a metal plate via a stamping press. Two bipolar plates are then coupled to each other. Accordingly, coolant flows in a channel space defined by contact of the bipolar plates, and Gas Diffusion Layers (GDL's) are disposed at both sides of the bipolar plates so that hydrogen and oxygen flow in respective channel spaces defined between the GDLs and the bipolar plates so as to transfer reactant gases. However, due to the significant forces imposed on the metal plate during the stamping process, the center region 52 of the die assembly (upper and/or lower die sets) will tend to cave in relative to the outer regions 50. This causes the load applied in the stamping process to be non-uniform thereby causing undesirably uneven depth within the flow channels and metal beads. As indicated earlier, efficient performance from a bipolar plate requires uniform channel depth as well as uniform bead depth.

With reference again to FIG. 1, the example bipolar plate 110 having flow channels 112 for use in a PEM fuel cell stack is shown. It is understood that the bipolar plate 110 may be made from a sheet of steel. It is understood that it is critical to maintain a substantially uniform flow channels 112 and metal bead seal 114 depth in order to provide a robust and efficiently operating structure. The sheet metal used in bipolar plates are approximate in the range of 0.07 to 0.12 thick. Moreover, flow channel 112 depths in a bipolar plate may approximately be in the range of 0.2 to 0.8. While the metal beads should preferably have a depth in the approximate range of 0.4 to 1.2. The depth of the flow channels should be substantially uniform and the depth of the metal beads should be substantially uniform in order to obtain efficient performance from the bipolar plate/fuel cell. In order to achieve uniform deformation in the channels and bead seals across the width and length of the bipolar plate (via a microstamping process), the die assembly should remain rigid in a stamping press and apply an average forming pressure evenly across the sheet metal. That is, the die face needs to be applied evenly across the sheet metal in order to achieve uniform channel depth and uniform bead depth.

Referring now to FIG. 2, a traditional die assembly 116 is shown for use in a stamping press (not shown). The traditional die assembly 116 includes a die plate 118 which has curves and recesses (not shown) formed in the die plate 118 for shaping at least a portion of sheet metal that is inserted into a stamping press machine. The die plate 118 may be mounted on a flat die stiffener 120 as shown. The flat die stiffener 120 is then affixed to a die shoe 122 and the die shoe 122 is mounted on a press base 124 as shown. However, due to significant loads in bipolar plate forming that are applied to the traditional die assembly shown, the inner region 126 of the die plate 118 and the die stiffener 122 generally begins to cave in relative to the outer regions 128 of the die plate 118 and the die stiffener 120. Therefore, any channels or formations that need to be formed in a piece of sheet metal may not reach their desired depth due to the deformation in the center region of the traditional die assembly.

The above information disclosed in this Background section is only for enhancement of understanding of the background of the invention, and therefore, it may contain information that does not form the prior art that is already known in this country to a person of ordinary skill in the art. Accordingly, there is a need for an improved die assembly which forms stamped components with much greater dimensional accuracy when evenly applying a significant load and deformation across the die and sheet metal.

SUMMARY

The present disclosure provides for a die assembly for use in a stamping press. The die assembly of the present disclosure may be used in a microstamping process where dimensional accuracy is critical. The die assembly includes a first die set which includes a first die plate, a first curved die stiffener, and a first die shoe. The first die plate may be configured to form at least a portion of material into a desired configuration. The first curved die stiffener may be affixed to the first die plate on a first curved side of the first curved die stiffener. The first die shoe may be affixed to a second side of the first curved die stiffener. The first die shoe may be operatively configured to be mounted on a first press base.

The present disclosure may also optionally further provide a second die set 34 which consists of a second die plate, a second curved die stiffener, and a second die shoe. The second die plate may be aligned opposite the first die plate when installed for use in stamping press machine. The second die plate may configured to form at least portion of material into a desired product together with the first die plate. The second curved die stiffener may be affixed to the second die plate on a first curved side of the second curved die stiffener. The second die shoe may be affixed to a second side of the second curved die stiffener, the second die shoe operatively configured to be mounted on a second press base.

Each first curved side of the first curved die stiffener and the second curved die stiffener may define a convex surface in both the lateral and longitudinal directions of each curved die stiffener. Moreover, the first press base and/or the second press base may be configured to be used in a stamping press machine. It is understood that the first die plate, the first curved die stiffener and the first die shoe are each formed from steel as well as the second die plate, the second curved die stiffener and the second die shoe may each be formed from steel. It is further understood that the first die plate, the first curved die stiffener and the first die shoe are affixed to one another with a plurality of mechanical fasteners. Similarly, the second die plate, the second curved die stiffener and the second die shoe may be affixed to one another via a plurality of fasteners.

The stiffener could be also arranged in a way that the curved surface faces die shoe and flat surface faces the die plate to achieve a desired uniformity of channel depth. Alternatively, it is understood that any one of the first curved die stiffener and the second curved die stiffener may have a first curved surface and a second surface which is also curved.

The present disclosure and its particular features and advantages will become more apparent from the following detailed description considered with reference to the accompanying drawings.

BRIEF DESCRIPTION OF THE DRAWINGS

These and other features and advantages of the present disclosure will be apparent from the following detailed description, best mode, claims, and accompanying drawings in which:

Like reference numerals refer to like parts throughout the description of several views of the drawings.

DETAILED DESCRIPTION

Figure 1:
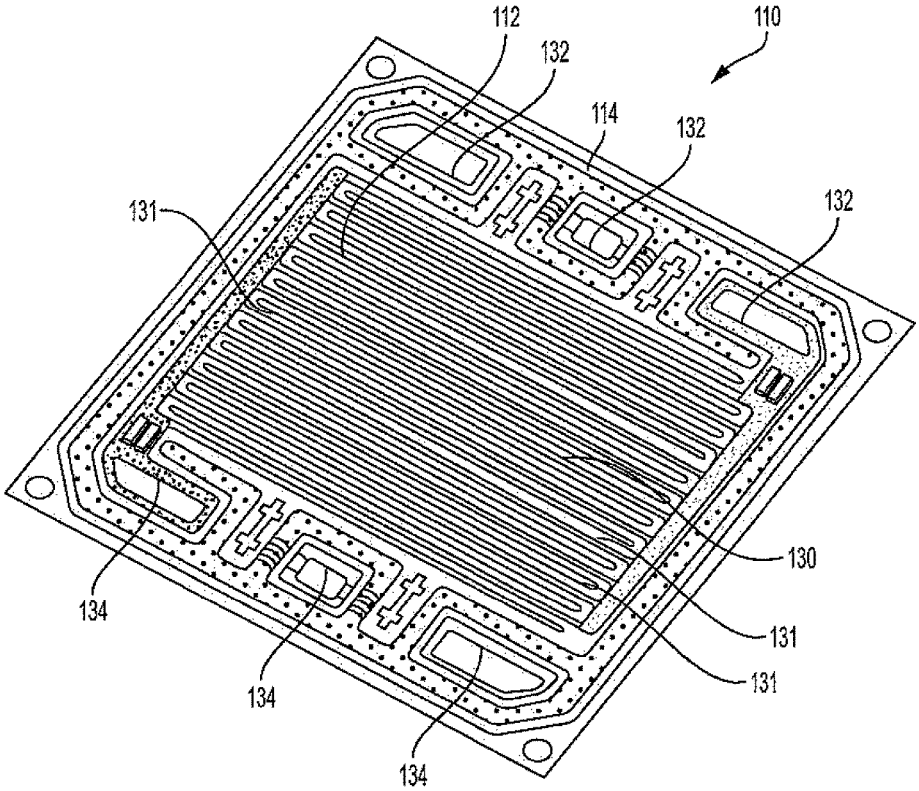
FIG. 1 is top view of an example bipolar plate used in a PEM fuel cell.
Figure 2:
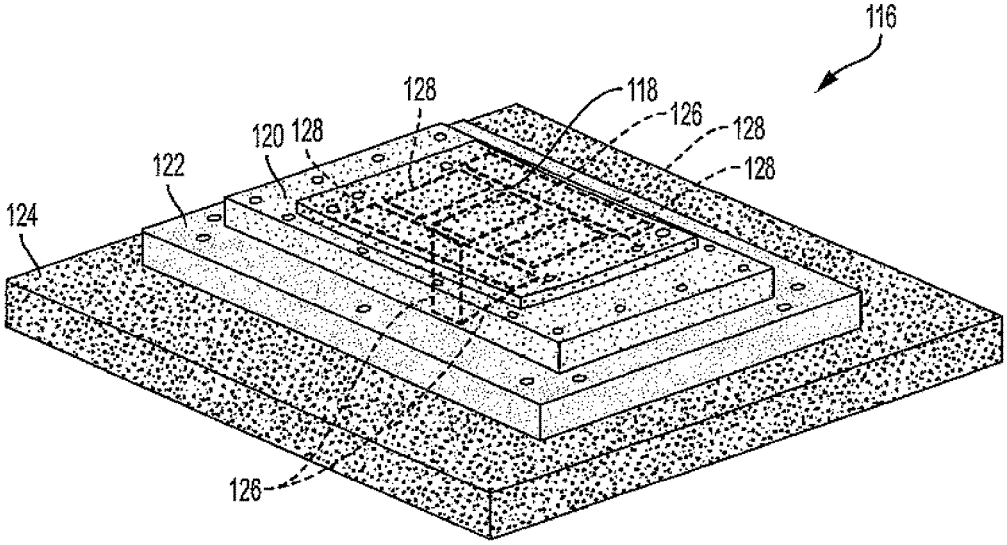
FIG. 2 is a perspective view of a traditional flat stiffener which is assembled to a press base, die shoe, and die plate in a stamping press.

Reference will now be made in detail to presently preferred compositions, embodiments and methods of the present disclosure, which constitute the best modes of practicing the present disclosure presently known to the inventors. The figures are not necessarily to scale. However, it is to be understood that the disclosed embodiments are merely exemplary of the present disclosure that may be embodied in various and alternative forms. Therefore, specific details disclosed herein are not to be interpreted as limiting, but merely as a representative basis for any aspect of the present disclosure and/or as a representative basis for teaching one skilled in the art to variously employ the present disclosure.

Except in the examples, or where otherwise expressly indicated, all numerical quantities in this description indicating amounts of material or conditions of reaction and/or use are to be understood as modified by the word "about" in describing the broadest scope of the present disclosure. Practice within the numerical limits stated is generally preferred. Also, unless expressly stated to the contrary: percent, "parts of," and ratio values are by weight; the description of a group or class of materials as suitable or preferred for a given purpose in connection with the present disclosure implies that mixtures of any two or more of the members of the group or class are equally suitable or preferred; the first definition of an acronym or other abbreviation applies to all subsequent uses herein of the same abbreviation and applies mutatis mutandis to normal grammatical variations of the initially defined abbreviation; and, unless expressly stated to the contrary, measurement of a property is determined by the same technique as previously or later referenced for the same property.

It is also to be understood that this present disclosure is not limited to the specific embodiments and methods described below, as specific components and/or conditions may, of course, vary. Furthermore, the terminology used herein is used only for the purpose of describing particular embodiments of the present disclosure and is not intended to be limiting in any way.

It must also be noted that, as used in the specification and the appended claims, the singular form "a," "an," and "the" comprise plural referents unless the context clearly indicates otherwise. For example, reference to a component in the singular is intended to comprise a plurality of components.

The term "comprising" is synonymous with "including," "having," "containing," or "characterized by." These terms are inclusive and open-ended and do not exclude additional, un-recited elements or method steps.

The phrase "consisting of" excludes any element, step, or ingredient not specified in the claim. When this phrase appears in a clause of the body of a claim, rather than immediately following the preamble, it limits only the element set forth in that clause; other elements are not excluded from the claim as a whole.

The phrase "consisting essentially of" limits the scope of a claim to the specified materials or steps, plus those that do not materially affect the basic and novel characteristic(s) of the claimed subject matter.

The terms "comprising", "consisting of", and "consisting essentially of" can be alternatively used. Where one of these three terms is used, the presently disclosed and claimed subject matter can include the use of either of the other two terms.

Throughout this application, where publications are referenced, the disclosures of these publications in their entireties are hereby incorporated by reference into this application to more fully describe the state of the art to which this present disclosure pertains.

The following detailed description is merely exemplary in nature and is not intended to limit the present disclosure or the application and uses of the present disclosure. Furthermore, there is no intention to be bound by any theory presented in the preceding background or the following detailed description.

Figure 4:
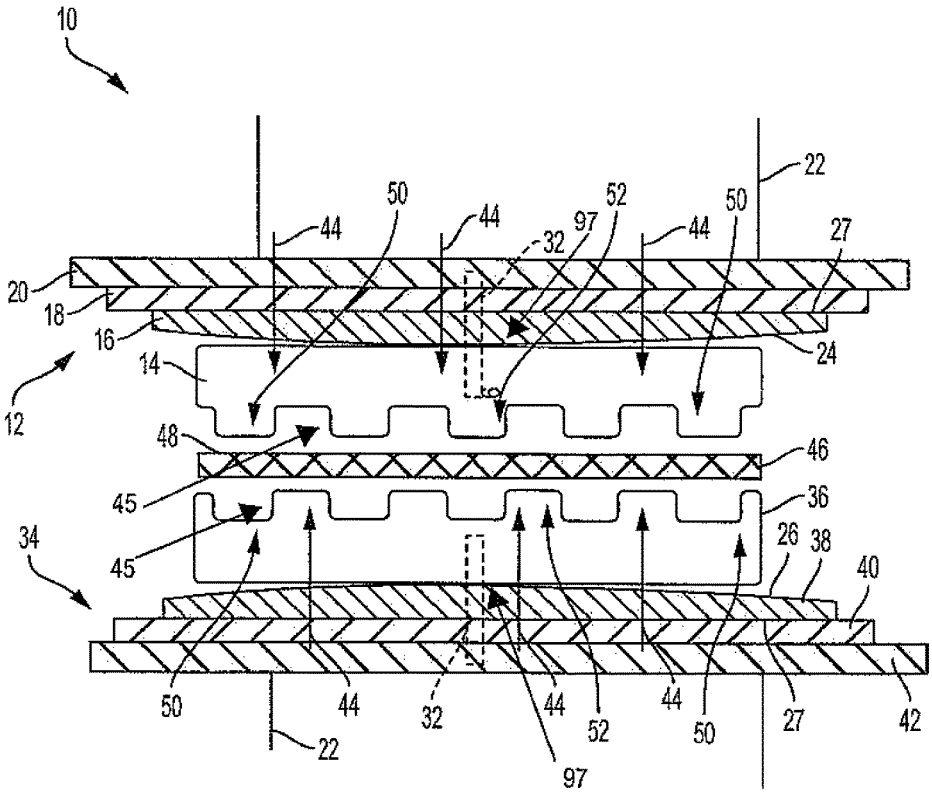
FIG. 4 is a side schematic view of a die assembly for a stamping press in accordance with various embodiments of the present disclosure.

The present disclosure provides for a die assembly for use in a stamping press 22. The die assembly of the present disclosure may be used in a microstamping process or a stamping process where dimensional accuracy is critical. With reference to FIG. 4, the die assembly includes a first die set 12 which includes at least a first die plate 14, a first curved die stiffener 16, and a first die shoe 18. The first die plate 14 may be configured to form at least a portion 48 of material into a desired configuration. The first curved die stiffener 16 may be affixed to the first die plate 14 on a first curved side of the first curved die stiffener 16. The first die shoe 18 may be affixed to a second side of the first curved die stiffener 16. The first die shoe 18 may be operatively configured to be mounted on a first press base 20.

The present disclosure may also further provide a second die set 34 which includes at least a second die plate 36, a second curved die stiffener 38, and a second die shoe 40 as shown in FIG. 4. The second die plate 36 may be aligned opposite the first die plate 14 when installed for use in stamping press machine 22 as shown in FIG. 4 such that the sheet metal 46 subject to the stamping process is inserted there between. The second die plate 36 may be configured to form at least a portion 48 of material (sheet metal 46) into a desired configuration when compressed between the second die plate 36 and the first die plate 14. The second curved die stiffener 38 may be affixed to the second die plate 36 on a first curved side of the second curved die stiffener 38. The second die shoe 40 may be also affixed to a second side of the second curved die stiffener 38. As shown, the second die shoe 40 may be operatively configured to be mounted on a second press base 42.

Figure 3:
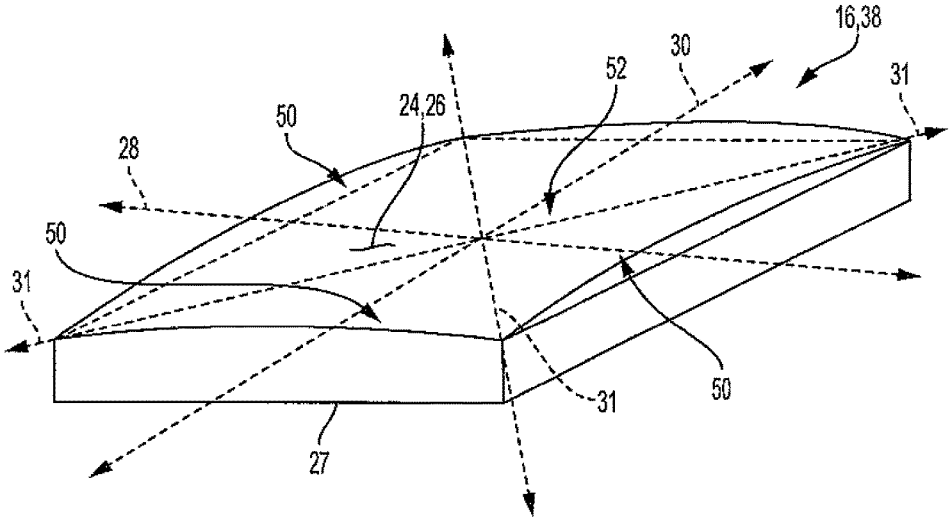
FIG. 3 is an isometric view of a curved stiffener in accordance with various embodiments of the present disclosure.

With reference to FIG. 3, the curved stiffener 16, 38 is shown by itself. The curved stiffener shown in FIG. 3 may be the first curved stiffener 16 of the first die set 12 or the second curved stiffener 38 of the second die set 34. Regardless, the curved stiffener for the die assembly of the present disclosure includes a first curved surface 24 and a second surface 27. The first curved surface 24 may define a convex surface 26 in both the lateral and longitudinal directions 28, 30 for each of the first and second curved stiffeners 16, 38. Accordingly, the center region 52 of each curved stiffener on the first curved surface 24 is operatively configured to force the center region 52 of the corresponding die plate toward the sheet metal 46 inserted into the stamping press 22. Therefore the curved surface may compensate for any sagging which may occur in the center region 52 of the first and/or second die sets 12, 34. Therefore, the desired load 44 and corresponding deformation at the center region 52 of the sheet metal 46 is substantially equal to the load 44 and corresponding deformation at the outer regions 50 of the sheet metal 46—resulting in a load 44 distribution across the die plate in order to flatten the die plate across the sheet metal. As a result, dimensional accuracy is achieved in the stamped part due to the flatness of the die surface/die plate contact the sheet across the sheet metal 46 when the stamping press 22 is in operation. Therefore, it is understood that the first convex surface 26 of each of the first and second die stiffeners are configured to compensate for any deformation that may occur in the center region 52 of the die assembly—due to the significant stamping loads applied to the die assembly during the operation of a stamping press 22.

Referring again to FIG. 3, a second surface 27 on each of the first and second curved stiffeners is provided opposite the first curved surface 24. The second surface 27 may, but not necessarily, be a flat surface. Alternatively, the second surface may also be a curved convex surface similar to the first surface. The second surface 27 for each of the first and second curved stiffeners may be disposed adjacent and/or abut a facing surface of the corresponding die shoe (shown in FIG. 4). Each first curved side of the first curved die stiffener 16 and the second curved die stiffener 38 may define a convex surface 26 in both the lateral and longitudinal directions 28, 30 of each curved die stiffener in order to ensure even load distribution 44 across the die plate and sheet metal 46 when the stamping press 22 is in operation. Again, the curved surface in both the lateral and longitudinal directions 28, 30 of each curved die stiffener 16, 38 allows for die plate 14, 36 surface flatness—that is, evenly distributing a stamping press load 44 across an engagement surface 45 in both the lateral and longitudinal directions 28, 30. By evenly distributing a stamping press load 44 across engagement surface 45 for each die plate 14, 36, the engagement surface 45 is substantially parallel to the (portion of) sheet metal 46 such that the depth of any deformations or channels 70 (shown in FIG. 5) is substantially uniform whether the channel or deformation is formed in the center region 52 (shown in FIG. 5) of the sheet metal 46 or the outer regions 50 (shown in FIG. 5) of the sheet metal 46 due to even an even deformation for each feature (ex: flow channel). It is understood that the convex surface 26 on the first curved side of each of the first and second curved die stiffeners may also be curved in the diagonal directions 31 (shown in FIG.

3) of each curved die stiffener. Accordingly, the convex surface 26 of each stiffener may, but not necessarily, be in the form of a portion of a spherical surface where the apex 97 (shown in FIGS. 4 and 5) of the convex surface (spherical surface) is the region of the convex surface which abuts the corresponding die plate. It is understood that the relative height 99 (shown in FIG. 5) between the apex of each convex surface may be anywhere in the range of about 0.001 mm to about 0.020 mm. It is also understood that engagement surface 45 for each of the first and second die plates of FIG. 4 is the entire surface of each die plate which faces the sheet metal 46.

As shown in FIG. 4, the first press base 20 and/or the second press base 42 may be configured to be used in a stamping press machine 22. It is understood that the first die plate 14, the first curved die stiffener 16 and the first die shoe 18 are each formed from steel as well as the second die plate 36, the second curved die stiffener 38 and the second die shoe 40 may also each be formed from steel. It is further understood that the first die plate 14, the first curved die stiffener 16 and the first die shoe 18 are affixed to one another with at least one mechanical fastener 32. Similarly, the second die plate 36, the second curved die stiffener 38 and the second die shoe 40 may be affixed to one another via a plurality of fasteners.

Therefore, in one non-limiting example, screws (schematically represented as element 32) may fasten and secure the working components which correspond to the first (upper) and second (lower) die shoes. The socket head cap screw may be an example mechanical fastener used in stamping dies. The socket head cap screw is a hardened tool steel screw and may also be referred to as an Allen head screw. Such fasteners offer superior holding power and strength in a stamping press 22 operation. Dowels (not shown) are hardened, precision-ground pins that precisely locate the die section or component in its proper location on the die shoe. Although dowels have much heeling ability, their main function is to locate the die section properly.

Figure 5:
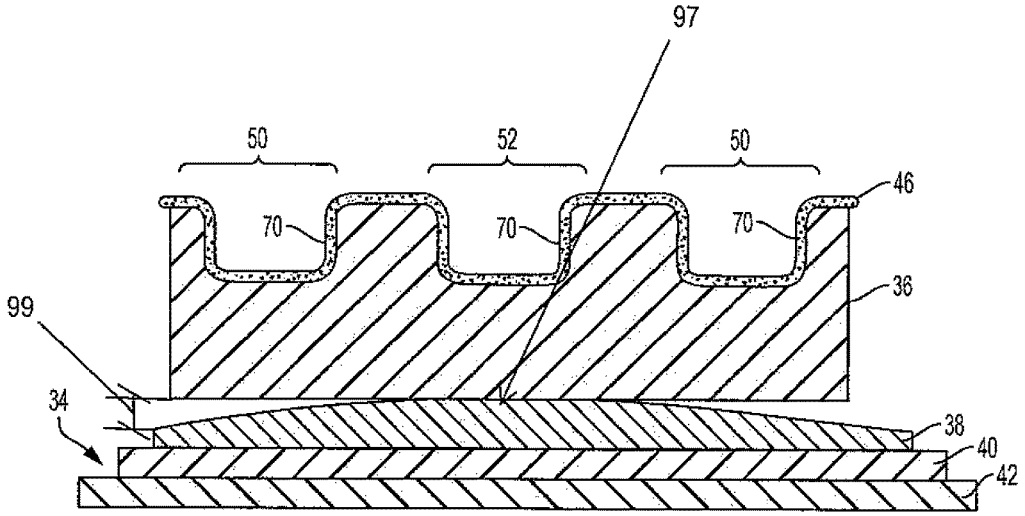
FIG. 5 is a side schematic view of a stamped bipolar plate in a lower half of the die assembly of FIG. 4.

With reference now to FIG. 5, the second die plate 36, the second curved die stiffener 38, the second die shoe 40, and the second press base 42 is shown with the formed sheet metal 46 in the second die plate 36 after a stamping operation as occurred. As shown, the stamped depth in the sheet metal 46 in the outer regions 50 is or should be substantially equal to the stamped depth (for the same feature such as a flow channel) in the center region 52 of the sheet metal 46 due to the even deformation distribution 44 across the die plate and the sheet metal 46 —wherein the second die plate 36 is flatly distributed across the sheet metal 46.

Figure 6:
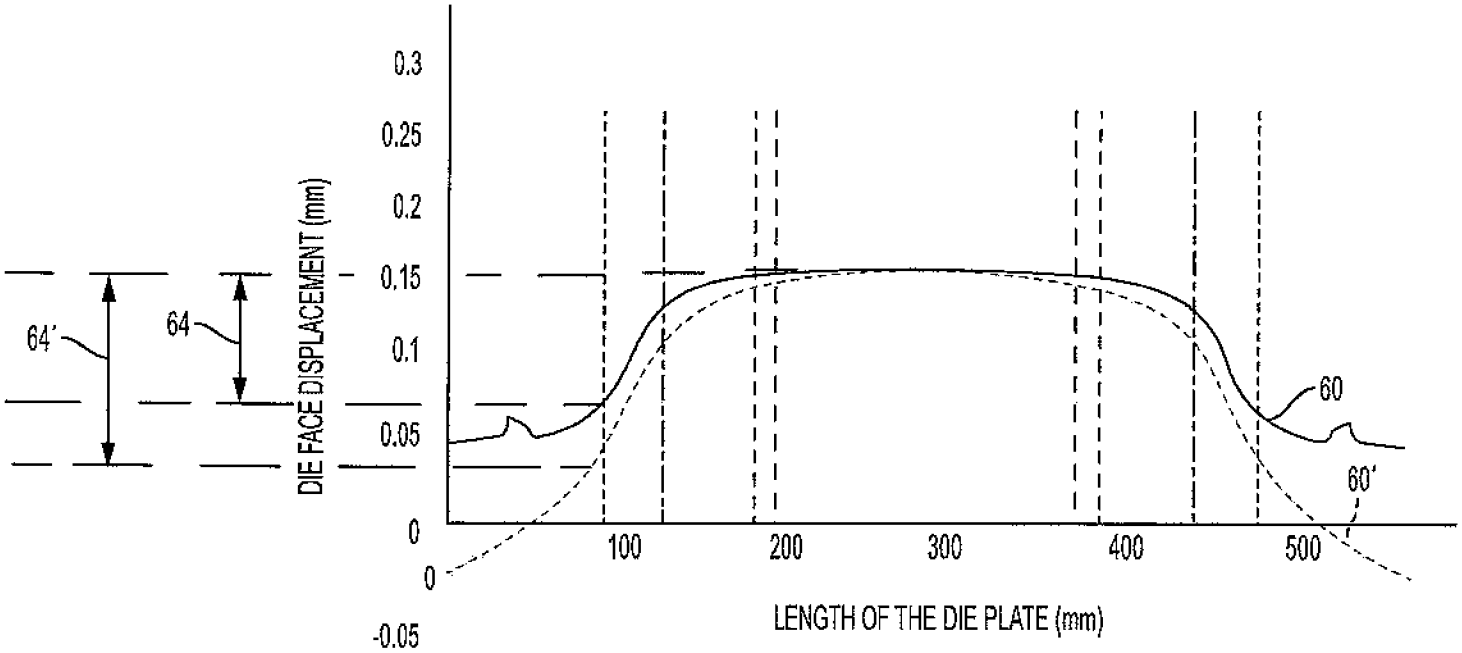
FIG. 6 is a graph which illustrates a comparison of the relative displacement along the length of a die face when a curved stiffener is used versus when a flat stiffener is used.
Figure 7:
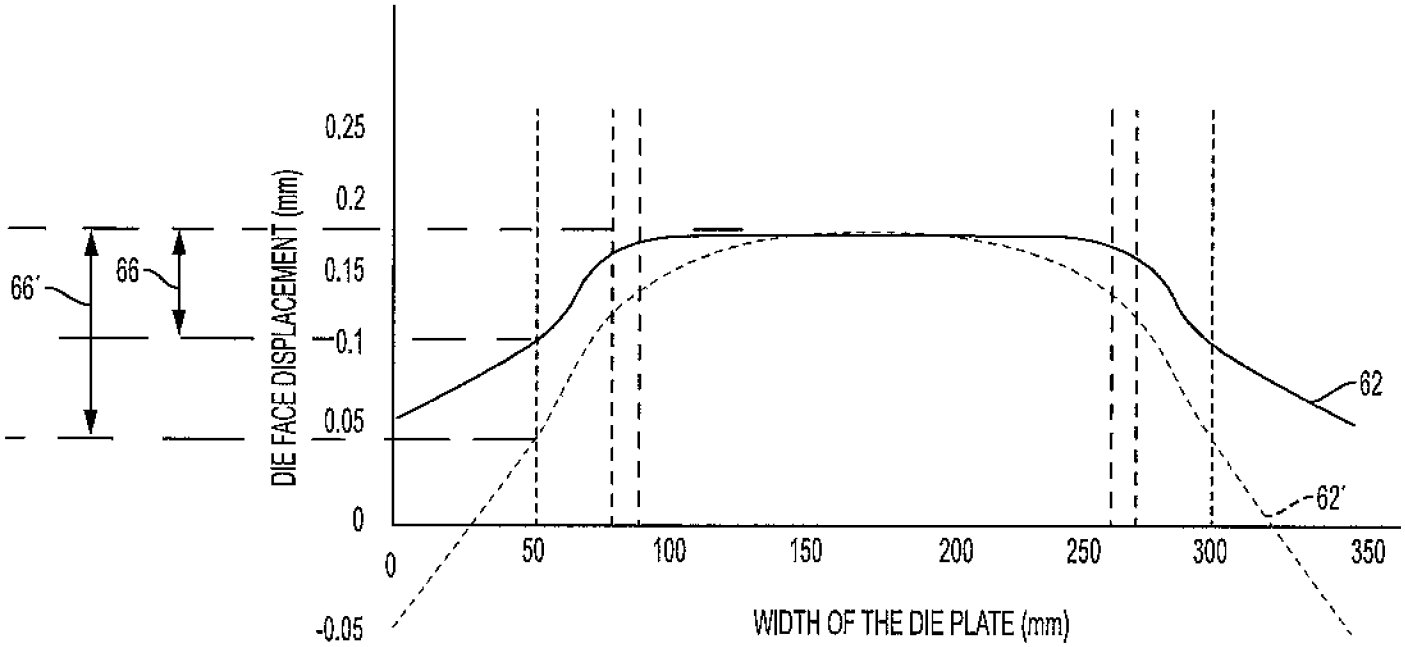
FIG. 7 is a graph which illustrates a comparison of the relative displacement along the width of a die face when a curved stiffener is used versus when a flat stiffener is used.

Referring now to FIG. 6, a graph is provided which illustrates a comparison of the displacement 60 of the die plate along the length of a die face when a curved stiffener is used versus the displacement 60' of the die plate when a flat stiffener is used. As shown, the die plate displacement 64 along the length of the die plate has less variation relative to the center when a curved stiffener is used. That is, when a curved stiffener is used and data is taken along the length of the die assembly, the relative vertical displacement 64 of the outer regions 50 (shown in FIG. 4) of the die plate 14, 36 compared to the center region 52 (shown in FIG. 4) is reduced when compared to the vertical displacement 64' that occurs with a traditionally flat stiffener. Moreover, with reference to FIG. 7, a graph is provided which illustrates the relative displacement 62 of the outer regions 50 (shown in FIG. 4) a die face compared to the displacement at the center region 52 (shown in FIG. 4) of a die face—when a curved stiffener is used. The displacement 62' of a die plate is also shown in FIG. 7 where a flat stiffener is used. That is, the relative displacement 66' between the outer regions 50 (shown in FIG. 4) and the center region 52 (shown in FIG. 4) is greater (where a flat stiffener is used) than the relative displacement 66 when a curved stiffener is used. As illustrated, variability in the die displacement 64, 66 is reduced when a curved stiffener 12, 26 is used. Accordingly, channels 70 formed into a sheet 46 of metal may generally have a substantially same dimension.

While at least one exemplary embodiment has been presented in the foregoing detailed description, it should be appreciated that a vast number of variations exist. It should also be appreciated that the exemplary embodiment or exemplary embodiments are only examples, and are not intended to limit the scope, applicability, or configuration of the disclosure in any way. Rather, the foregoing detailed description will provide those skilled in the art with a convenient road map for implementing the exemplary embodiment or exemplary embodiments. It should be understood that various changes can be made in the function and arrangement of elements without departing from the scope of the disclosure as set forth in the appended claims and the legal equivalents thereof.

What is claimed is:

1. A die assembly for use in a stamping press, the die assembly comprising:

a first die plate configured to form at least a portion of material into a desired product;

a first curved die stiffener affixed to the first die plate on a first curved side of the first curved die stiffener;

a first die shoe affixed to a second side of the first curved die stiffener, the first die shoe operatively configured to be mounted on a first press base;

a second die plate aligned opposite the first die plate, the second die plate configured to form at least a portion of material into a desired product together with the first die plate;

a second curved die stiffener affixed to the second die plate on a first curved side of the second curved die stiffener; and a second die shoe affixed to a second side of the second curved die stiffener, the second die shoe operatively configured to be mounted on a second press base.

2. The die assembly as defined in claim 1 wherein the first curved side of the first curved die stiffener defines a convex surface in a lateral direction and a longitudinal direction of the first curved die stiffener.

3. The die assembly as defined in claim 1 wherein the first press base is configured to be used in a stamping press machine.

4. The die assembly as defined in claim 1 wherein the first die plate, the first curved die stiffener and the first die shoe are each formed from steel or cast iron or other metals.

5. The die assembly as defined in claim 1 wherein the first die plate, the first curved die stiffener and the first die shoe are affixed to one another with a plurality of mechanical fasteners.

6. The die assembly as defined in claim 1 wherein the first curved die stiffener is operatively configured to evenly distribute a stamping press load across an engagement surface of the first die plate when the stamping press is in operation.

7. The die assembly as defined in claim 6 wherein the first curved die stiffener and the first die plate are operatively configured to form substantially uniform channels across the portion of material.

8. The die assembly as defined in claim 1 wherein the second curved die stiffener and the second die plate are operatively configured to form substantially uniform channels across the portion of material.

9. The die assembly as defined in claim 1 wherein the first curved side of the second curved die stiffener defines a convex surface in a lateral direction and a longitudinal direction of the second curved die stiffener.

10. The die assembly as defined in claim 1 wherein the second side of the second curved die stiffener defines a convex surface in a lateral direction and a longitudinal direction of the second curved die stiffener.

11. The die assembly as defined in claim 1 wherein the first and the second press bases are configured to be used in a stamping press machine.

12. The die assembly as defined in claim 1 wherein the second die plate, the second curved die stiffener and the second die shoe are each formed from at least one of steel or cast iron.

13. The die assembly as defined in claim 1 wherein the second die plate, the second curved die stiffener and the second die shoe are affixed to one another via at least one mechanical fastener.

14. The die assembly as defined in claim 1 wherein the first curved die stiffener, the first die plate and the first die shoe are layered on each other such that the first curved die stiffener is disposed between the first die plate and the first die shoe.

15. A die assembly for use in a stamping press, the die assembly comprising:

a first die plate configured to form at least a portion of material into a desired product;

a first curved die stiffener affixed to the first die plate on a first curved side of the first curved die stiffener;

a first die shoe affixed to a second side of the first curved die stiffener, the first die shoe operatively configured to be mounted on a first press base;

a second die plate aligned opposite the first die plate; and a second curved die stiffener affixed to the second die plate on a first curved side of the second curved die stiffener, and the second curved die stiffener is operatively configured to evenly distribute a stamping press load across an engagement surface of the second die plate when the stamping press is in operation.

16. The die assembly as defined in claim 15:

wherein the second die plate is configured to form at least a portion of material into a desired product together with the first die plate; and further including a second die shoe affixed to a second side of the second curved die stiffener, the second die shoe operatively configured to be mounted on a second press base.

17. The die assembly as defined in claim 16 wherein the second curved die stiffener, the second die plate and the second die shoe are layered on each other such that the second curved die stiffener is disposed between the second die plate and the second die shoe.

18. The die assembly as defined in claim 15 wherein the first curved die stiffener, the first die plate and the first die shoe are layered on each other such that the first curved die stiffener is disposed between the first die plate and the first die shoe.

19. The die assembly as defined in claim 15 wherein the first curved die stiffener is disposed between the first die plate and the first die shoe.

20. The die assembly as defined in claim 15 wherein:

the first curved side of the first curved die stiffener defines a convex surface in a lateral direction and a longitudinal direction of the first curved die stiffener;

the first curved die stiffener is operatively configured to evenly distribute a stamping press load across an engagement surface of the first die plate when the stamping press is in operation; and the first curved side of the second curved die stiffener defines a convex surface in a lateral direction and a longitudinal direction of the second curved die stiffener.

* * * * *